US011613832B2

(12) United States Patent
Giorgi et al.

(10) Patent No.: US 11,613,832 B2
(45) Date of Patent: Mar. 28, 2023

(54) OPEN TOE SOCK WITH TOE ANCHOR

(71) Applicant: NIKE, Inc., Beaverton, OR (US)

(72) Inventors: Allison K. Giorgi, Portland, OR (US); Trina Z. Murrietta, Portland, OR (US); Ronen Yehuda, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 17/853,374

(22) Filed: Jun. 29, 2022

(65) Prior Publication Data

US 2022/0325448 A1 Oct. 13, 2022

Related U.S. Application Data

(62) Division of application No. 16/704,089, filed on Dec. 5, 2019, now abandoned.

(60) Provisional application No. 62/785,928, filed on Dec. 28, 2018.

(51) Int. Cl.

| | |
|---|---|
| ***D04B 1/26*** | (2006.01) |
| ***A41B 11/00*** | (2006.01) |
| ***D04B 1/10*** | (2006.01) |
| *A43B 5/12* | (2006.01) |

(52) U.S. Cl.

CPC ..... *D04B 1/26* (2013.01); *D04B 1/108* (2013.01); *D04B 1/265* (2013.01); *A41B 11/004* (2013.01); *A43B 5/12* (2013.01)

(58) Field of Classification Search

CPC ..... D04B 1/26; D04B 1/265
USPC ..... 66/178 R
See application file for complete search history.

(56) References Cited

U.S. PATENT DOCUMENTS

| | | | |
|---|---|---|---|
| 246,454 | A | 8/1881 | Bruen |
| 335,704 | A | 2/1886 | Hoult |
| 482,095 | A | 9/1892 | McClurg |
| 1,459,590 | A | 6/1923 | Anthony |
| 1,665,946 | A | 4/1928 | Boehme |
| 1,680,859 | A | 8/1928 | Peter |
| 1,726,441 | A | 8/1929 | Loven |

(Continued)

FOREIGN PATENT DOCUMENTS

| | | | |
|---|---|---|---|
| AU | 5206799 | A | 1/2000 |
| CA | 2883763 | A1 | 9/2016 |

(Continued)

OTHER PUBLICATIONS

Notice of Allowance received for U.S. Appl. No. 16/704,352, dated Oct. 12, 2022, 13 pages.

(Continued)

*Primary Examiner* — Danny Worrell
*Assistant Examiner* — Grace Huang
(74) *Attorney, Agent, or Firm* — Shook, Hardy & Bacon L.L.P.

(57) ABSTRACT

Aspects herein are directed to a sock and methods for forming the sock on a circular knitting machine. The sock in accordance with aspects herein having a plurality of toe-anchor knit courses that form a toe anchor that divides a toe-end opening of the sock into a first toe-end opening and a second toe-end opening by extending across the toe-end opening from a dorsal portion of the toe-end opening to a plantar portion of the toe-end opening. The toe-anchor knit courses are integrally knit with the sock body.

20 Claims, 7 Drawing Sheets

(56) References Cited

U.S. PATENT DOCUMENTS 1,731,696 A 10/1929 Zinky
1,789,494 A 1/1931 Page
1,811,786 A * 6/1931 Frei ..... D04B 9/52 D2/986
1,870,701 A 8/1932 Williams
1,906,137 A 4/1933 Davis
1,954,711 A 4/1934 James et al.
1,975,706 A * 10/1934 Allen ..... D04B 9/46 66/187
1,984,970 A 12/1934 Goodman
1,987,090 A 1/1935 Gustav
2,002,888 A 5/1935 Gastrich
2,047,724 A 7/1936 Zuckerman
2,061,160 A 11/1936 Kendall
2,217,273 A 10/1940 Harris
2,237,652 A 4/1941 Salvatore
2,247,832 A 7/1941 Burd et al.
2,248,303 A 7/1941 Frank et al.
2,250,257 A 7/1941 Erich et al.
2,391,064 A 12/1945 Stokes
2,400,692 A * 5/1946 Herbert ..... D04B 1/108 66/171
2,412,087 A 12/1946 Herbert
2,424,056 A 7/1947 Ruth
2,514,456 A 7/1950 Carl
2,616,275 A 11/1952 Bennington
2,628,438 A 2/1953 Luchs
2,629,995 A * 3/1953 Hamilton ..... D04B 11/28 66/172 R
2,629,996 A * 3/1953 Hamilton ..... D04B 1/26 66/172 R
2,771,691 A 11/1956 Luchs
3,015,942 A * 1/1962 Getaz ..... A41B 11/00 66/186
3,173,278 A * 3/1965 Kaylor ..... D04B 1/26 66/172 R
3,187,522 A * 6/1965 Knohl ..... D04B 1/108 66/172 R
3,289,328 A 12/1966 Abel
3,334,356 A 8/1967 Abel
3,453,843 A * 7/1969 Knohl ..... D04B 1/26 66/190
3,601,818 A 8/1971 Chesebro et al.
3,793,851 A 2/1974 Thorneburg
3,838,583 A 10/1974 Rumi et al.
3,887,946 A 6/1975 Laskin et al.
4,027,667 A * 6/1977 Swallow ..... A61F 13/08 602/76
4,194,249 A 3/1980 Thorneburg
4,197,721 A 4/1980 Hofmann et al.
4,631,755 A 12/1986 Zingg et al.
4,723,364 A 2/1988 Marxer
5,020,164 A 6/1991 Edwards
5,054,129 A 10/1991 Baehr
5,095,548 A 3/1992 Chesebro, Jr.
5,230,333 A 7/1993 Yates et al.
5,450,630 A 9/1995 Hale
5,560,226 A 10/1996 Throneburg
D375,195 S 11/1996 Panassidi
5,603,232 A 2/1997 Throneburg
5,784,721 A 7/1998 Huff
5,802,877 A * 9/1998 Yates ..... D04B 9/56 66/185
5,867,837 A 2/1999 Otto et al.
5,867,838 A 2/1999 Corry
5,906,007 A 5/1999 Roberts
6,044,497 A 4/2000 Richardson
6,173,589 B1 1/2001 Hayes et al.
6,226,800 B1 5/2001 Islar
6,324,698 B1 12/2001 Freeman
6,381,755 B2 5/2002 Cortani
6,393,620 B2 5/2002 Hatch et al.
6,415,448 B1 7/2002 Glogover
6,564,392 B1 5/2003 Buckwald
D476,147 S 6/2003 Campbell
6,708,348 B1 3/2004 Romay
D488,918 S 4/2004 Mays et al.
7,051,457 B1 5/2006 Huggins et al.
7,103,922 B1 9/2006 Doorley
7,107,626 B1 * 9/2006 Andrews ..... A41B 11/004 2/239
D538,527 S 3/2007 Ransan
7,213,417 B2 5/2007 Lonati et al.
D543,676 S 6/2007 Kim et al.
D581,654 S 12/2008 Miliotis
7,673,396 B2 3/2010 Terlizzi et al.
7,849,609 B2 12/2010 Edington et al.
7,856,739 B2 12/2010 Terlizzi et al.
7,882,714 B2 2/2011 Roberts
8,156,768 B2 4/2012 Green et al.
8,448,350 B2 5/2013 Nataadiningrat et al.
9,380,831 B2 7/2016 Craig et al.
D769,611 S 10/2016 Ramirez-tellez Shah
9,609,896 B2 4/2017 Crosby
9,661,892 B2 5/2017 Meir
D791,466 S 7/2017 Flynn
D802,292 S 11/2017 Patterson
D803,543 S 11/2017 Scott et al.
D803,544 S 11/2017 Ramirez-tellez Shah
10,039,329 B2 8/2018 Sherry
10,077,512 B2 9/2018 Kuo et al.
10,106,921 B2 10/2018 Ciocca
10,876,231 B2 * 12/2020 Idobata ..... D04B 1/24
2006/0218973 A1 10/2006 Kim et al.
2008/0034802 A1 2/2008 Hirao et al.
2009/0158504 A1 6/2009 Sparrow et al.
2010/0037370 A1 2/2010 Busi
2010/0050321 A1 3/2010 Martini
2013/0152275 A1 6/2013 Crosby
2013/0160192 A1 6/2013 Stuart
2014/0033567 A1 2/2014 Heathcote et al.
2014/0259260 A1 * 9/2014 Behrend ..... A63B 71/1225 2/22
2014/0317833 A1 * 10/2014 Craig ..... A41B 11/00 2/239
2016/0029704 A1 2/2016 Jung et al.
2016/0081836 A1 3/2016 Sawle et al.
2016/0227843 A1 8/2016 Bilsky et al.
2016/0242471 A1 8/2016 Marville
2017/0143059 A1 5/2017 Gallagher
2017/0175310 A1 6/2017 Rees-jones et al.
2017/0347723 A1 12/2017 Millet et al.
2018/0220714 A1 8/2018 Amis et al.
2018/0343927 A1 12/2018 Roe
2019/0167462 A1 * 6/2019 Shaffer ..... A61F 5/0127
2020/0205480 A1 7/2020 Giorgi et al.
2020/0205481 A1 7/2020 Amis et al.
2020/0205484 A1 * 7/2020 Yehuda ..... A41B 11/002

FOREIGN PATENT DOCUMENTS

CH 313745 A 5/1956
CN 200966318 Y 10/2007
CN 202197844 U 4/2012
CN 203814602 U 9/2014
CN 106307626 A 1/2017
CN 106605951 A 5/2017
CN 107173854 A 9/2017
DE 202012004652 U1 8/2013
GB 2138852 A 10/1984
GB 2378891 A 2/2003
GB 2472586 A 2/2011
JP 3114044 U 9/2005
JP 3117585 U 1/2006
JP 2012034718 A * 2/2012 ..... D04B 1/26
JP 5961781 B1 7/2016
KR 10-0709266 B1 4/2007
KR 10-1071167 B1 10/2011
TW M483681 U 8/2014
WO 00/00049 A1 1/2000
WO 2004/023904 A1 3/2004
WO 2012/032458 A2 3/2012

(56) References Cited

FOREIGN PATENT DOCUMENTS

OTHER PUBLICATIONS

Brand New Ballet Dance Toe Pad Practice Shoes Foot Thong Protection Dance Sock for Latin Costume Gaiters Accessories, AliExpress&trade, Available online at: <aliexpress.com>, Accessed on Jul. 30, 2018, 7 pages.
Cassie casual sheer stripe anklet, Sock Dreams, sockdreams.com, Tavi Noir, SKU [TN]-[T02822S], Available online at—https://www.sockdreams.com/cassie-casual-sheer-stripe-anklethtml.
Circulator compression knee high—smaller feet, Sock Dreams, sockdreams.com, sockwell, SKU [SW]-[SW1W], Available online at—https://www.sockdreams.com/circulator-compression-knee-high-smaller-feethtml.
SmartKnit Big Toe AFO Socks for Adults, Knit-Rite® direct, knitritedirectcom, tern#: KR-SK-BTS-A, Available online at—https://www.knitritedirect.com/smartknit-big-toe-afo-socks-for-adults.html.
Stretch Lace Thong Sock Black Toeless Lace Sock Black Lace Socks Sandal Foot Bear Toes Stockings, Etsy, Available online at: <etsy.com>, Jul. 22, 2018, 4 pages.
Wholesale-Footful Pair Foot Thong Toe Undies, Dance Paws, Half Lyrical Shoe Forefoot Cover Sock H1274, DHgate, Available online at: <https://www.dhgate.com/product/wholesale-footful-pair-foot-thong-toe-undies/264994642.html>, Accessed on Jul. 30, 2018, 6 pages.
Non-Final Office Action received for U.S. Appl. No. 17/853,330, dated Jan. 27, 2023, 16 pages.

* cited by examiner

OPEN TOE SOCK WITH TOE ANCHOR

CROSS REFERENCE TO RELATED APPLICATIONS

This U.S. application Ser. No. 17/853,374 filed on Jun. 29, 2022, and entitled "OPEN TOE SOCK WITH TOE ANCHOR," is a Divisional Application of U.S. application Ser. No. 16/704,089, filed Dec. 5, 2019, and entitled "OPEN TOE SOCK WITH TOE ANCHOR," which in turn claims priority to U.S. Provisional Application No. 62/785,928, filed Dec. 28, 2018, and entitled "OPEN TOE SOCK WITH TOE ANCHOR," the contents of which are hereby incorporated by reference herein in their entireties.

TECHNICAL FIELD

Aspects herein are directed to a sock with an open toe structure and an integrally knit toe anchor.

BACKGROUND

Traditional toe anchors are generally formed in a post-knitting step by affixing a strap to a sock using, for example, stitching. In instances where the strap is formed during the knitting of the sock, generally at least one end of the strap is affixed to the sock using, for instance, stitching.

BRIEF DESCRIPTION OF THE DRAWINGS

Examples of aspects herein are described in detail below with reference to the attached drawing figures, wherein.

DETAILED DESCRIPTION OF THE INVENTION

Figure 1:
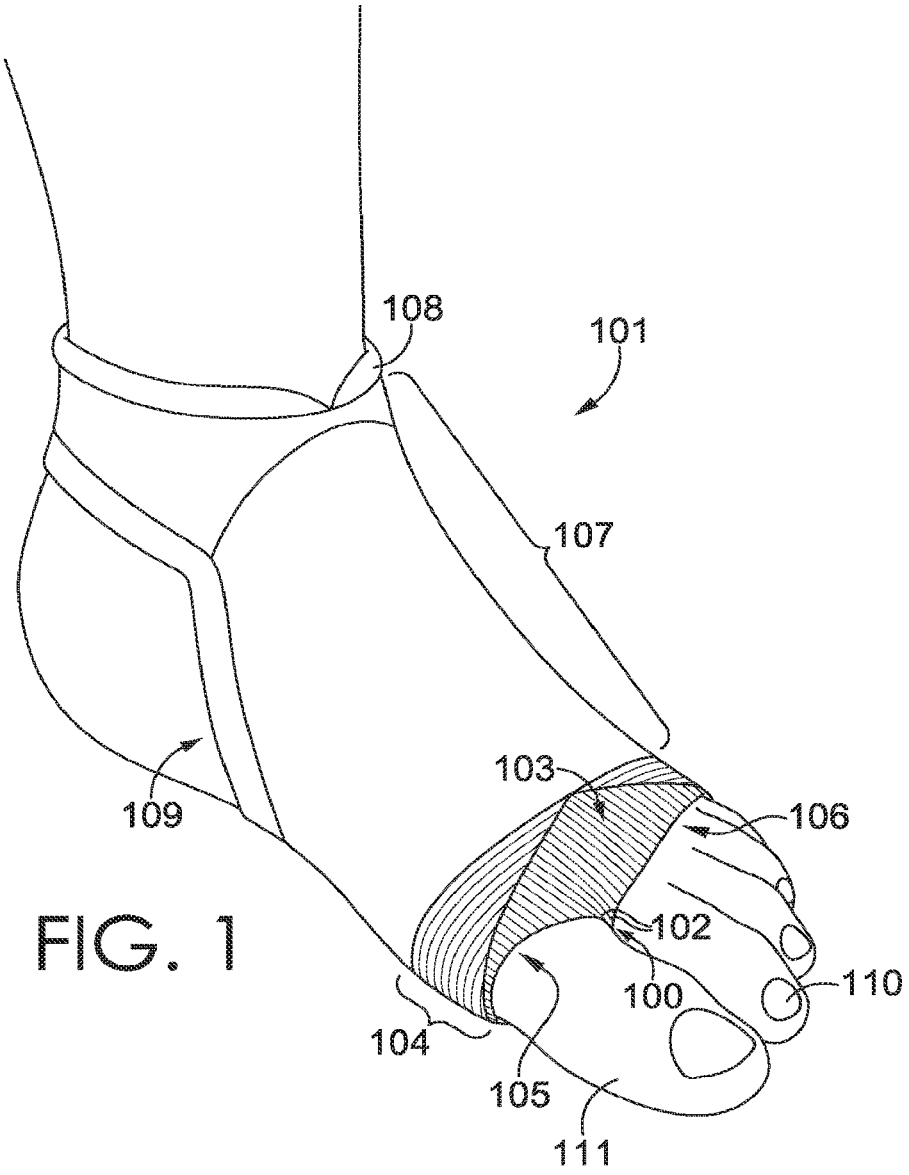
FIG. 1 illustrates a wearer wearing a sock having an integrally knit toe anchor in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

At a high level, aspects herein are directed to a sock having an integrally knit toe anchor. In example aspects, the sock comprises a tubular sock body formed from a plurality of circumferentially extending knit courses. The tubular sock body forms a perimeter around a foot-receiving cavity where the foot-receiving cavity includes a toe-end opening. A plurality of toe-anchor knit courses that form the toe anchor are integrally knit with the plurality of circumferentially extending knit courses and divide the toe-end opening into a first toe-end opening and a second toe-end opening by extending across the toe-end opening from a dorsal portion of the tubular sock body to a plantar portion of the tubular sock body. The sock thus described provides an open-toe sock with an integrally knit toe anchor. An integrally knit toe anchor, besides helping to secure the sock to a foot of a wearer, may provide more structural stability compared to toe anchors that are secured to the sock by, for example, stitching, as the stitching may come undone, fray, or break causing the stitched toe anchor to become disengaged from the sock. Integrally knit toe anchors also provide a manufacturing efficiency because no additional post-knitting steps are necessary to, for instance, form the toe anchor and affix the toe anchor to the sock.

To describe these aspects differently, a tubular sock body with a collar and a heel area is provided. The sock body further includes a toe area with a toe-end opening, where the toe area is integrally knit with the sock body. In example aspects, the toe area comprises a dorsal portion and a plantar portion where the dorsal portion comprises a knit dorsal triangular panel having a dorsal vertex that extends toward the collar and dorsal base that forms a portion of a perimeter of the toe-end opening of the toe area. The plantar portion of the toe area comprises a knit plantar triangular panel having a plantar vertex that extends toward the heel area and a plantar base that forms a remaining portion of the perimeter of the toe-end opening of the toe area. Continuing, toe-anchor knit courses extend between the dorsal base and the plantar base of the toe area to form a first toe-end opening and a second toe-end opening separated by the toe-anchor knit courses. It is contemplated herein that the first toe-end opening and second toe-end opening may comprise different circumferences and/or diameters. In some aspects, the first toe-end opening is configured to receive a first hallux when the sock is worn, and the second toe-end opening is configured to receive the remaining toes of the wearer when the sock is worn. In addition to the advantages detailed above, an integrally knit toe anchor may also be more comfortable to the wearer of the sock as there are no seams or stitching that may chaff the wearer. In some aspects, the integrally knit toe anchor may be formed using an elastomeric yarn to provide stretch and comfort to the wearer. As well, the elastomeric yarn may be knit to have larger loops to provide an additional degree of mechanical stretch.

In further aspects, it is contemplated that the collar of the tubular sock body forms an opening in communication with the foot-receiving cavity. It is further contemplated that the heel area comprises a heel opening configured to receive at least a portion of a wearer's heel when the sock is worn. In example aspects, the sock described herein may be suitable for activities such as yoga, barre classes, Pilates, and the like which require the wearer's feet and toes to be able to grab a floor or exercise surface.

It is contemplated herein that the sock, including the integrally knit toe anchor, is knit on a circular knitting machine. For instance, a first plurality of circumferentially extending knit courses may be knit to form a first end and a second end of a tubular body. The knitting further includes integrally knitting a dorsal triangular panel with a first area of the second end of the tubular body, where the dorsal triangular panel comprises a dorsal base that forms a first portion of a perimeter edge of a toe-end opening of a toe area of the sock. In example aspects, the dorsal triangular panel is knit through a reciprocating motion on the circular knit machine using a first set of needles. Further, due to how the sock is turned on the circular knitting machine, the courses forming the dorsal triangular panel are oriented in a generally perpendicular direction to the circumferentially extending knit courses that form the tubular body. The knitting further includes integrally knitting a plantar triangular panel with a second area of the second end of the tubular body, where the second triangular panel comprises a plantar base that forms a second portion of the perimeter edge of the toe-end opening of the toe area of the sock. In example aspects, the plantar triangular panel is knit through a reciprocating motion on the circular knit machine using a second set of needles. Similar to the dorsal triangular panel, due to how the sock is turned on the circular knitting machine, the courses forming the plantar triangular panel are oriented in a generally perpendicular direction to the circumferentially knit courses that form the tubular body. The knitting may further comprise knitting a plurality of toe-anchor knit courses using, for instance a third set of needles, where the toe-anchor knit courses extend between the dorsal base and the plantar base to form a first toe-end opening and a second toe-end opening separated by the plurality of toe-anchor knit courses. It is contemplated herein that the third set of needles may comprises a subset of the first set of needles and/or the second set of needles.

With further respect to the knitting of the sock having the integrally knit toe anchor, in example aspects, at least the toe portion of the sock may comprise a series of reciprocally knit sections that are knit on the circular knitting machine using one or more sets of needles, while remaining needles on the circular knit machine are inactive. The series of reciprocally knit sections are integrally knit with each other, and it least one edge of one of the reciprocally knit sections comprises a free edge (i.e., an edge that is not integrally knit with another reciprocally knit section or with another portion of the sock). The free edge may be seamed to, for instance, the tubular body of the sock to form a toe seam, where the toe seam is generally located on the lateral side of the sock. It is contemplated herein that a technical face of the tubular sock body is external facing and the technical back of the tubular sock body is internal facing. That is, the technical back of the tubular body of the sock is configured to face inwardly and is configured to be adjacent to a wearer's foot when the sock is worn.

Positional terms as used herein such as "medial," "lateral," "dorsal," "plantar," "top," "bottom," and the like, are with respect to a sock being worn as intended and as shown and described herein by a wearer standing in anatomical position. Thus, the medial side of a sock would be positioned adjacent to a medial side of a wearer's foot when the sock is worn, and the lateral side of the sock would be positioned adjacent to a lateral side of the wearer's foot when the sock is worn. The dorsal portion or top of the sock would be positioned adjacent to the dorsum or top of the wearer's foot, and the plantar portion or bottom of the sock would be positioned adjacent to the sole of the wearer's foot when the sock is worn.

The term "knit course" as described herein is a predominantly horizontal row of knitted loops (in an upright fabric as knit) produced by adjacent needles during the same knitting cycle. The knit course may comprise one or more stitch types such as a loop stitch, a held stitch, a float stitch, a tuck stitch, a transfer stitch, and the like as these terms are known in the art of knitting. As used herein, the term "toe anchor" means a knit structure in a toeless sock configured to separate a wearer's first hallux from the remaining toes of the wearer's foot. The term "integrally knit" as used herein may mean a textile or fabric having a yarn from one or more knit courses being interlooped with one or more knit courses of another area. For instance, a toe anchor may be integrally knit with a sock body if a yarn from one or more knit courses of the toe anchor is interlooped, either directly or indirectly (i.e., by way of one or more reciprocally knit sections), with one or more knit courses in the sock body. The term "elastomeric" as used herein when describing yarns generally means a yarn type that may provide a maximum stretch greater than about 200% under load prior to returning to its non-stretched state when the load is removed, and some elastomeric yarns provide a maximum stretch of about 400%. Examples of elastomeric yarn types include LYCRA®, elastane, spandex, rubber, and the like. The term "generally" when used with respect to, for example, the orientation of the knit courses, may mean within about 10 to about 20 degrees of a parallel or perpendicular alignment, and the term "about" means within ±5% of a given value.

Turning now to FIG. 1, a wearer is shown wearing a knit sock 101 having a plurality of toe-anchor knit courses 102 that form a toe anchor 100 extending between a dorsal portion 103 and a plantar portion (not seen in FIG. 1) of a toe-end opening of a toe area 104 of the knit sock 101 to form a first toe-end opening 105 and a second toe-end opening 106. The knit sock 101 is shown in the form of a liner sock or a ped sock although other sock lengths are contemplated herein such as a no-show sock, a quarter sock, a crew sock, or an over the calf or executive sock. The knit sock 101 comprises a tubular sock body 107 having a first end and a second end. The first end of the sock body 107 includes a collar 108 that defines a foot opening for receiving the wearer's foot. The toe area 104 of the knit sock 101 is integrally knit with the second end of the tubular sock body 107. The knit sock 101 further comprises an optional heel opening 109 configured to receive at least a portion of the wearer's heel. FIG. 1 is provided to illustrate an example way of wearing the knit sock 101. For instance, the knit sock 101 may be donned with the wearer's foot inserted through the foot opening defined by the collar 108 and the wearer's heel received in the heel opening 109. The toe anchor 100 extends between the wearer's first hallux 111 and the wearer's second hallux 110.

Aspects herein contemplate the knit sock 101 is knit on a circular knit machine.

Aspects herein further contemplate that at least the toe anchor 100, the plantar portion of the toe area 104, (not shown in FIG. 1), and the dorsal portion 103 of the toe area 104 are formed through a reciprocal knitting process on the circular knit machine. It is contemplated herein that the toe anchor 100 may form a foot-locating feature that adapts the knit sock 101 to a left foot or a right foot of the wearer as described herein, although the toe anchor 100 may be positioned such that it does not form a foot-locating feature.

For illustrative purposes, the knit sock 101 will be described as if it is a sock being worn on a left foot of the wearer as shown in FIG. 1.

With continued reference to FIG. 1, as shown, in some aspects the first toe-end opening 105 is configured to receive the wearer's first hallux 111. In other example aspects, it is contemplated that the first toe-end opening 105 and second toe-end opening 106 comprise different circumferences and/or diameters to allow any combination of four or less toes to be received through the second toe-end opening 106. In some aspects, the second toe-end opening 106 has a larger circumference and/or diameter than the first toe-end opening 105.

Figure 2:
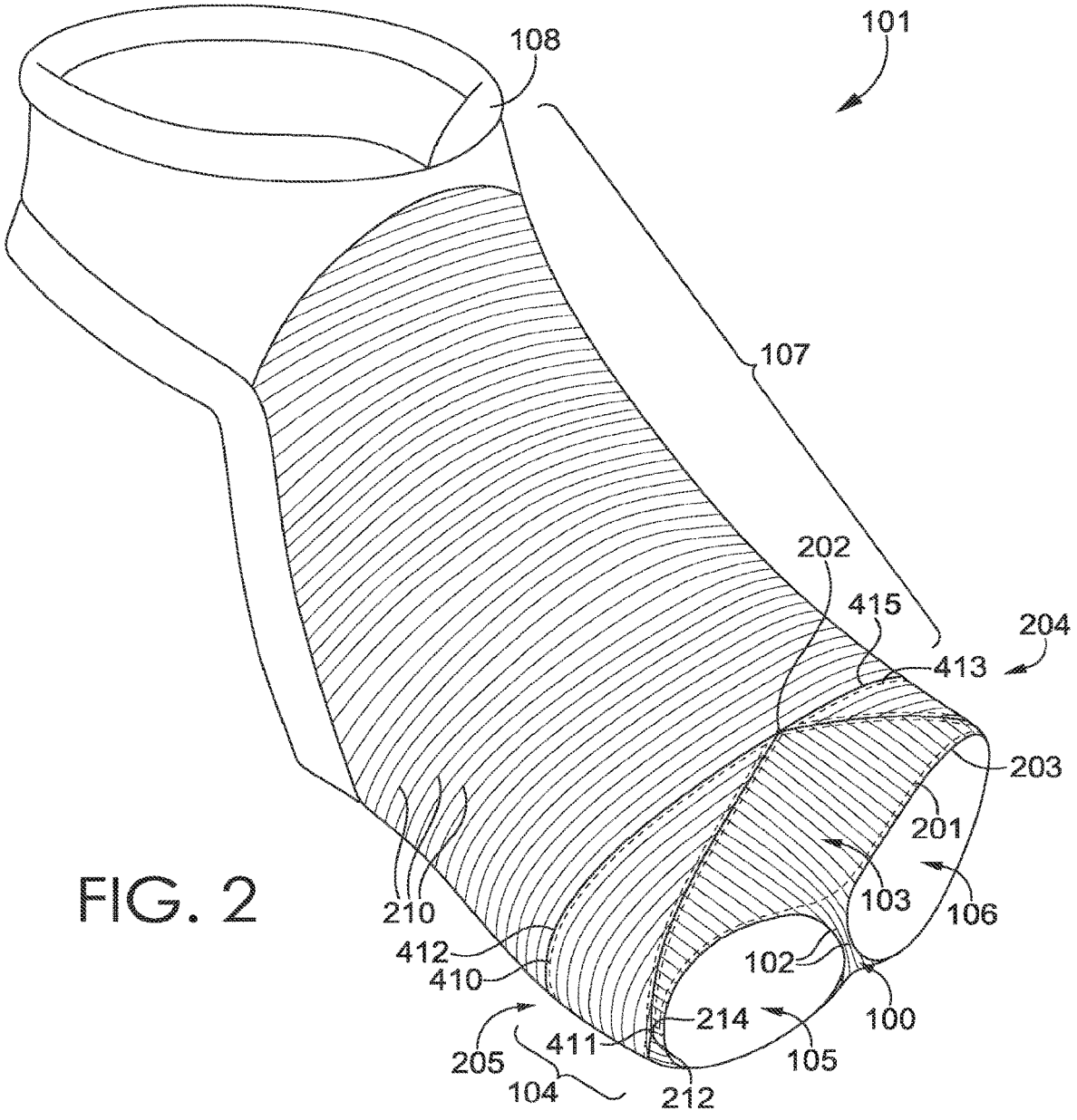
FIG. 2 illustrates a medial perspective view of a sock having an integrally knit toe anchor in accordance with aspects herein.
Figure 3:
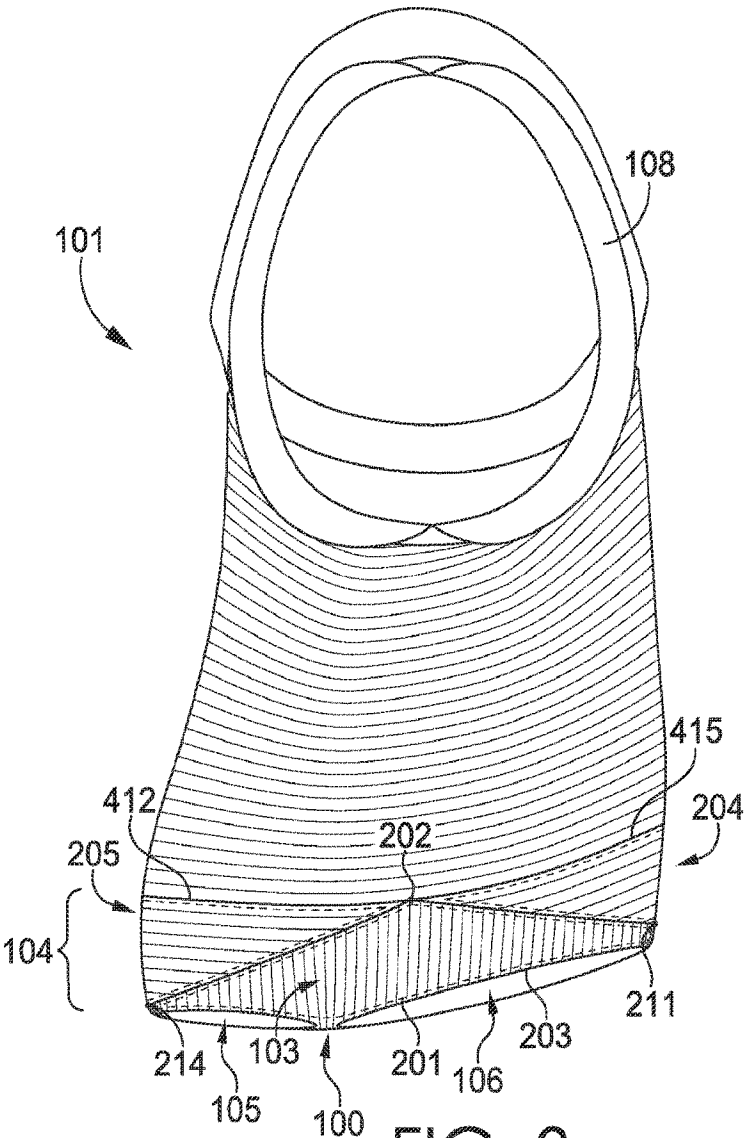
FIG. 3 illustrates a top view of the sock of FIG. 2 with a dorsal triangular panel in accordance with aspects herein.

FIG. 2 and FIG. 3 illustrate more aspects of the knit sock 101. FIG. 2 illustrates a medial perspective view of the knit sock 101 in an un-worn state in accordance with aspects herein. FIG. 3 illustrates a top view of the same knit sock 101. In example aspects, the toe area 104 includes the dorsal portion 103 and a plantar portion (shown in FIG. 4). The dorsal portion 103 comprises a knit dorsal triangular panel 201 with a dorsal vertex 202 extending towards the collar 108 and a dorsal base 203. In example aspects, the dorsal triangular panel 201 comprises three vertexes defined by a first dorsal base vertex 214, a second dorsal base vertex 211, and the dorsal vertex 202. The dorsal base 203 extends between the first dorsal base vertex 214 and the second dorsal base vertex 211 defining at least a first portion of a perimeter edge of the toe area 104.

Figure 4:
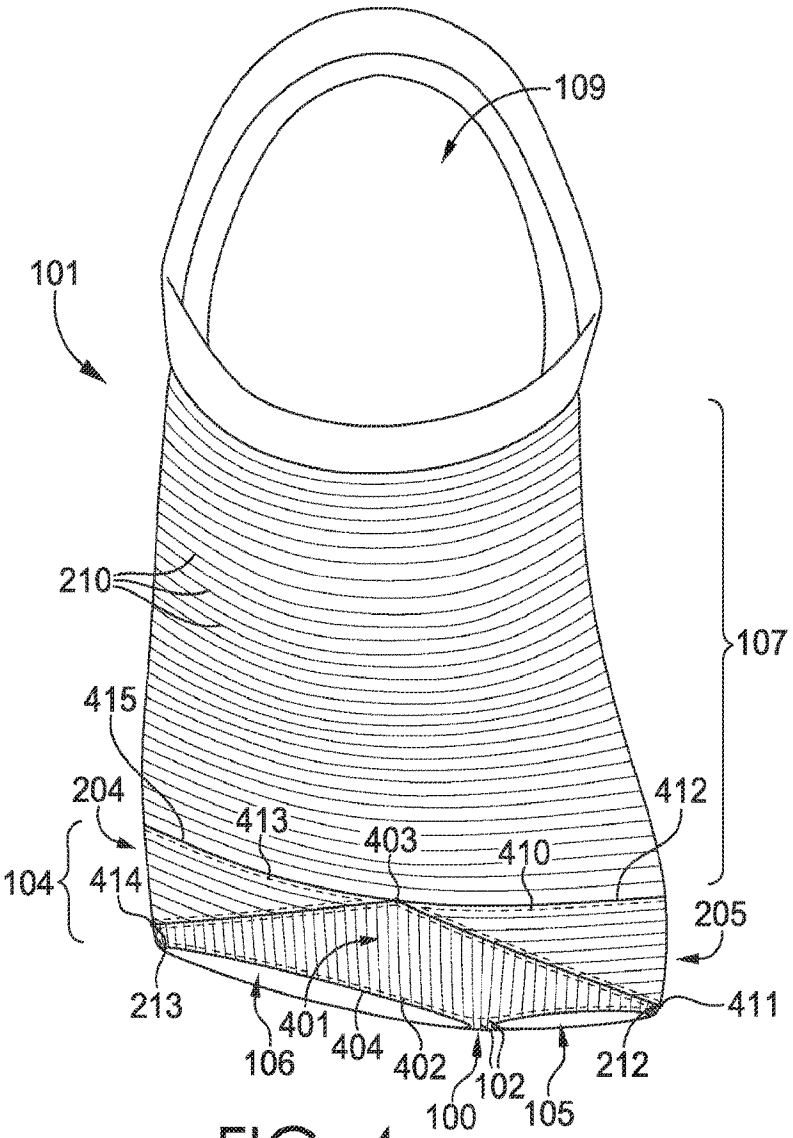
FIG. 4 illustrates a bottom view of the sock of FIG. 2 with a plantar triangular panel in accordance with aspects herein.

FIG. 4 illustrates a bottom or plantar view of the knit sock 101 in accordance with aspects herein. As shown in FIG. 4, the knit sock 101 further comprises the plantar portion 401. The plantar portion 401 comprises a plantar triangular panel 402 with a plantar base 404 and a plantar vertex 403 extending towards the heel opening 109 (when present) or a heel area of the knit sock 101. The plantar triangular panel 402 is defined by three vertexes, the plantar vertex 403, a first plantar base vertex 212 and a second plantar base vertex 213. The plantar base 404 extends between the first plantar base vertex 212 and the second plantar base vertex 213 defining at least a second portion of the perimeter edge of the toe area 104. The plantar triangular panel 402 and the dorsal triangular panel 201 are positioned on opposing sides of the knit sock 101. In example aspects, the first portion of the perimeter edge of the toe area 104 formed by the dorsal base 203 and the second portion of the perimeter edge of the toe area 104 formed by the plantar base 404 define an entire circumference of the toe-end opening of the toe area 104.

Referring to FIGS. 2-4, the plurality of toe-anchor knit courses 102 that form the toe anchor 100 extend between the dorsal base 203 of the dorsal triangular panel 201 and the plantar base 404 of the plantar triangular panel 402. The dorsal base 203, the plantar base 404, and the toe anchor 100 collectively form or define the first toe-end opening 105 and the second toe-end opening 106. To describe this differently, the dorsal base 203 and the plantar base 404 may define or form at least a portion of a perimeter edge of the first toe-end opening 105 and second toe-end opening 106, and the toe anchor 100 that extends between the dorsal base 203 and the plantar base 404 forms a remaining portion of the perimeter edge of the first toe-end opening 105 and the second toe-end opening 106. In this example aspect, the first dorsal base vertex 214 and the first plantar base vertex 212 may be located on a medial aspect of the toe area 104 of the knit sock 101 and the second dorsal base vertex 211 and second plantar base vertex 213 may be located on the lateral aspect of the toe area 104 of the knit sock 101.

The toe area 104 further comprises a medial portion 205 and a lateral portion 204. The medial portion 205 is formed from a medial triangular panel 410 with a medial vertex 411 extending toward the first toe-end opening 105, and a medial base 412 extending from the dorsal vertex 202 to the plantar vertex 403. In aspects, the medial base 412 forms a first portion (i.e., a medial portion) of a proximal end of the toe area 104. The lateral portion 204 is formed from a lateral triangular panel 413 with a lateral vertex 414 extending toward the second toe-end opening 106, and a lateral base 415 extending from the dorsal vertex 202 to the plantar vertex 403. In aspects, the lateral base 415 forms a second portion (i.e., a lateral portion) of the proximal end of the toe area 104. In some example aspects, the lateral base 415 may be seamed to the sock body 107 to form a lateral toe seam (i.e., a toe seam primarily located on the lateral side of the knit sock 101).

Continuing, in example aspects, the medial base 412 and the lateral base 415 define or form substantially all of the proximal end of the toe area 104 (e.g., they form from about 95% to about 100% of the proximal end of the toe area 104). It is contemplated herein that the medial portion 205, the lateral portion 204, the dorsal portion 103, and the plantar portion 401 may comprise a plurality of reciprocally knit sections that are integrally knit with each other and with the sock body 107 as will be explained further below. The combination of the medial portion 205, the lateral portion 204, the dorsal portion 103, and the plantar portion 401 extend the sock body 107 in a distal direction.

In some aspects, the sock body 107 of the knit sock 101 may comprise circumferentially extending knit courses 210. In some example aspects, the knit courses that form the lateral portion 204 and the medial portion 205 of the toe area 104 are in a generally parallel alignment with the knit courses 210, but are reciprocally knit such that at least a portion of the knit courses that form the lateral portion 204 and the medial portion 205 do not extend circumferentially around the knit sock 101. In example aspects, the knit courses that form the dorsal portion 103, the plantar portion 401, and the toe anchor 100 are in a generally perpendicular alignment with the knit courses 210 that form the sock body 107 and with the knit courses that form the lateral portion 204 and the medial portion 205.

Figure 5B:
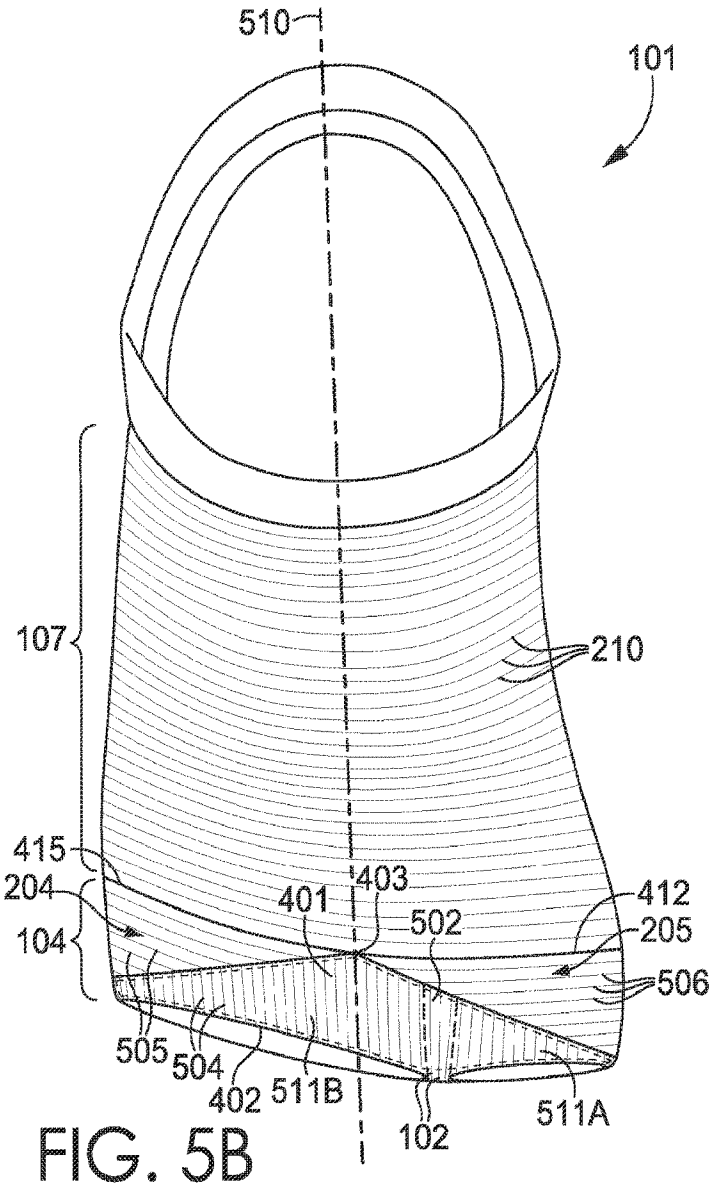
FIG. 5B illustrates a bottom view of the sock of FIG. 2 displaying an orientation of courses in accordance with aspects herein.
Figure 5A:
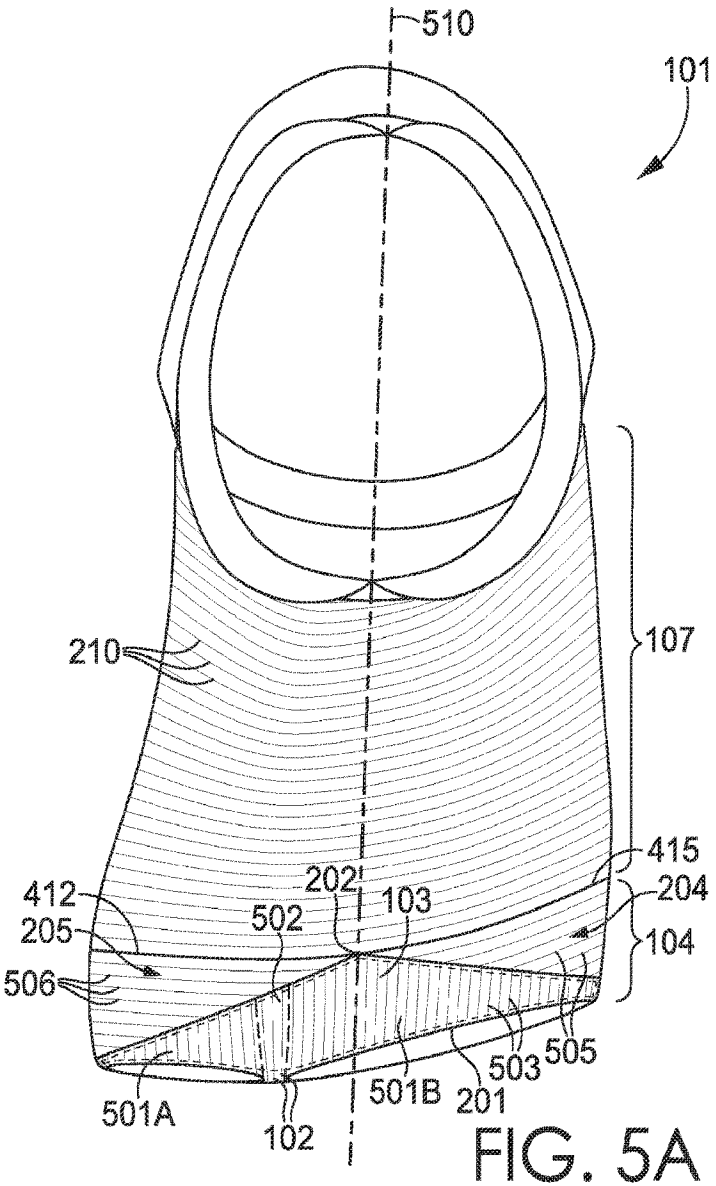
FIG. 5A illustrates a top view of the sock of FIG. 2 displaying an orientation of courses in accordance with aspects herein.

FIGS. 5A and 5B are provided to illustrate how the toe area 104 of the knit sock 101 may be knit from a number of reciprocally knit sections where FIG. 5A is a dorsal/top view of the knit sock 101 and FIG. 5B is a plantar/bottom view of the knit sock 101. With respect to FIG. 5A, the dorsal portion 103 of the toe area 104 comprises the dorsal triangular panel 201, and the dorsal triangular panel 201 comprises a first dorsal segment 501A, a toe anchor segment 502, and a second dorsal segment 501B. As shown in FIG. 5B, the plantar portion 401 of the toe area 104 comprises the plantar triangular panel 402, and the plantar triangular panel 402 includes a first plantar segment 511A, the toe anchor segment 502, and a second plantar segment 511B.

As previously discussed, the medial portion 205 comprises the medial base 412 extending from the dorsal vertex 202 to the plantar vertex 403, where the dorsal vertex 202 and the plantar vertex 403 are aligned on a bisecting reference plane 510 that divides the knit sock 101 into generally equal medial and lateral halves. In a similar manner, the lateral portion 204 comprises the lateral base 415 extending from the dorsal vertex 202 to the plantar vertex 403. As will be discussed further within, the lateral base 415 may represent the edge of the last reciprocally knit section that is seamed to the sock body 107. It is contemplated herein that the medial portion 205, at least a portion of the lateral portion 204, the dorsal portion 103, and the plantar portion 401 are integrally knit with each other and with the sock body 107.

In the same aspect, the dorsal portion 103 of the toe area 104 may comprise a plurality of reciprocally knit courses 503 extending generally perpendicular to the circumferentially extending knit courses 210 that form the sock body 107. And in the same aspect, the plantar portion 401 may comprise a plurality of reciprocally knit courses 504 extending generally perpendicular to the plurality of circumferentially extending knit courses 210 that form the sock body 107. To describe this in a different way, the knit courses 503 that form the dorsal portion 103 and the knit courses 504 that form the plantar portion 401 of the toe area 104 may be oriented to be generally perpendicular to the circumferentially extending knit courses 210 used to form the sock body 107. Similarly, the knit courses 503 that form the dorsal portion 103 and the knit courses 504 that form the plantar portion 401 may also be oriented generally perpendicular to knit courses 505 used to form the lateral portion 204 and knit courses 506 used to form the medial portion 205. The toe-anchor knit courses 102 may extend generally perpendicular to the plurality of circumferentially extending knit courses 210, and may extend generally perpendicular to the knit courses 506 that form the medial portion 205, and may extend generally perpendicular to the knit courses 505 that form the lateral portion 204. The toe-anchor knit courses 102 may extend generally parallel to the knit courses 503 that form the dorsal portion 103 and the knit courses 504 that form the plantar portion 401.

In some aspects of the knit sock 101, the sock body 107 and plurality of toe-anchor knit courses 102 may comprise an elastomeric yarn. Using an elastomeric yarn provides enhanced comfort to the wearer and allows the knit sock 101 to be donned and doffed more easily. Alternatively or additionally, it is contemplated that the toe-anchor knit courses 102 may have larger knitted loops than other courses in the knit sock 101. This feature allows a greater degree of mechanical stretch compared to areas of the knit sock 101 that are knit with a smaller knitted loop.

Figure 6:
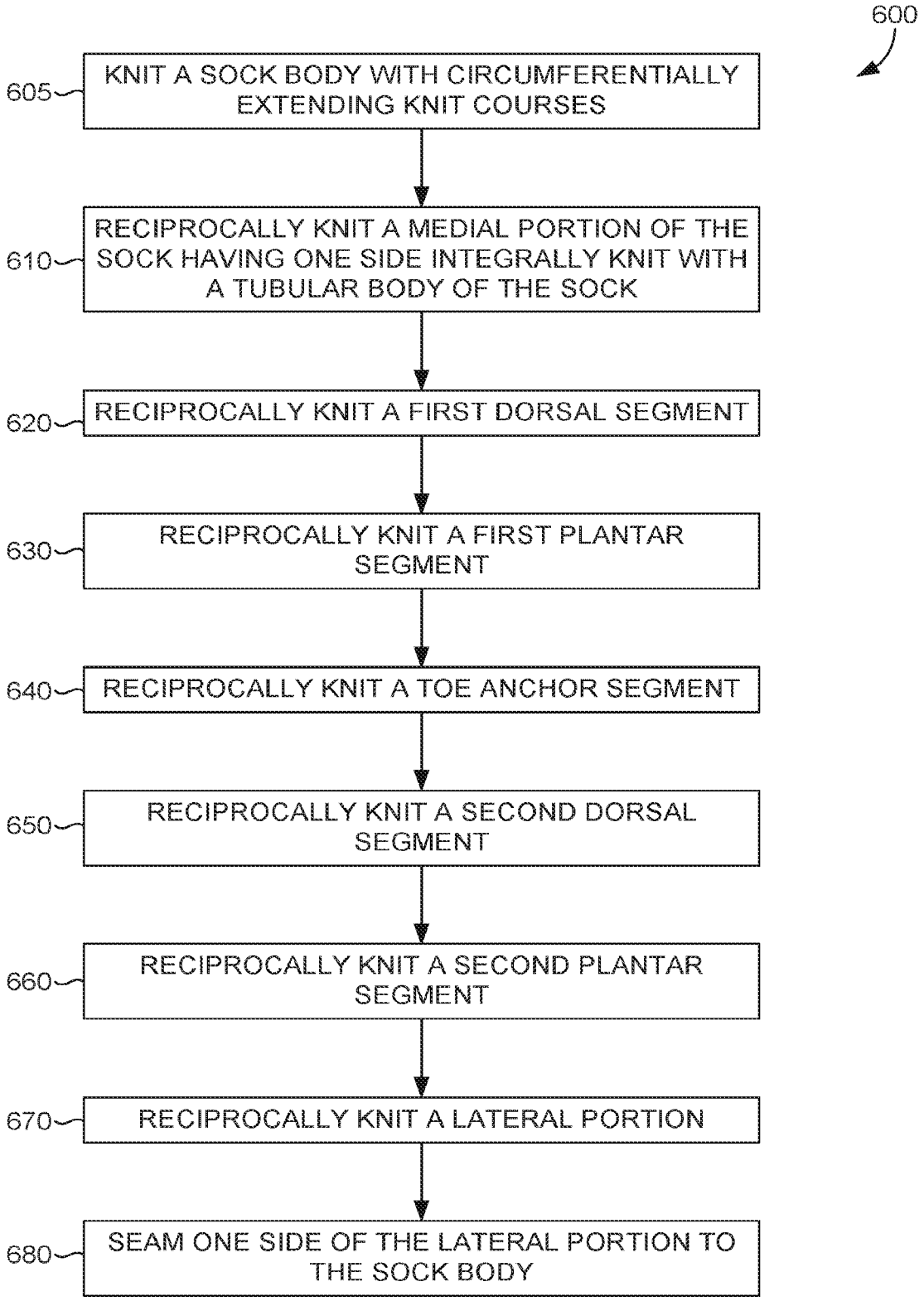
FIG. 6 illustrates a flow chart for a method of manufacturing a sock in accordance with aspects herein.

FIG. 6 depicts a flow chart of a method 600 of manufacturing the knit sock 101 in accordance with aspects herein is shown. For example, at step 605, a sock body, such as the sock body 107, with a plurality of circumferentially extending knit courses may be knit on a circular knitting machine using all the needles on the circular knitting machine. As shown at step 610, the method may further include reciprocally knitting a medial portion, such as medial portion 205, of the sock having one side, such as medial base 412, integrally knit with the sock body. At step 620, the method includes reciprocally knitting a first dorsal segment, such as first dorsal segment 501A, and at step 630, reciprocally knitting a first plantar segment, such as first plantar segment 511A where the first dorsal segment and the first plantar segment are integrally knit with the medial portion. At step 640, a toe anchor segment, such as toe anchor segment 502, is reciprocally knit where a first side of the toe anchor segment 502 is integrally knit the first dorsal segment and the first plantar segment. In example aspects, the toe anchor segment 502 comprises the toe anchor 100.

The knitting process may continue at step 650 with reciprocally knitting a second dorsal segment, such as the second dorsal segment 501B. Further, a second plantar segment may be reciprocally knit, such as the second plantar segment 511B, as shown at step 660. After step 660, a second side of the toe anchor segment is integrally knit with the second dorsal segment and the second plantar segment. The process may continue by reciprocally knitting a lateral portion, such as the lateral portion 204, with the second dorsal segment and the second plantar segment of the toe area 104 as shown at step 670. The lateral portion represents the final reciprocally knit section, and, as such, it comprises a free edge. Thus, step 680 includes seaming the free edge of the lateral portion to the sock body 107. The seaming may comprise a post-knitting step and include processes such as stitching, boding, embroidering, and the like, that would be useful for providing a toe seam in the toe area of the knit sock that is primarily located on a lateral side of the knit sock, in accordance with aspects herein.

Unless specified, the different reciprocally knit sections, segments, and portions are integrally knit with each other.

Figure 7:
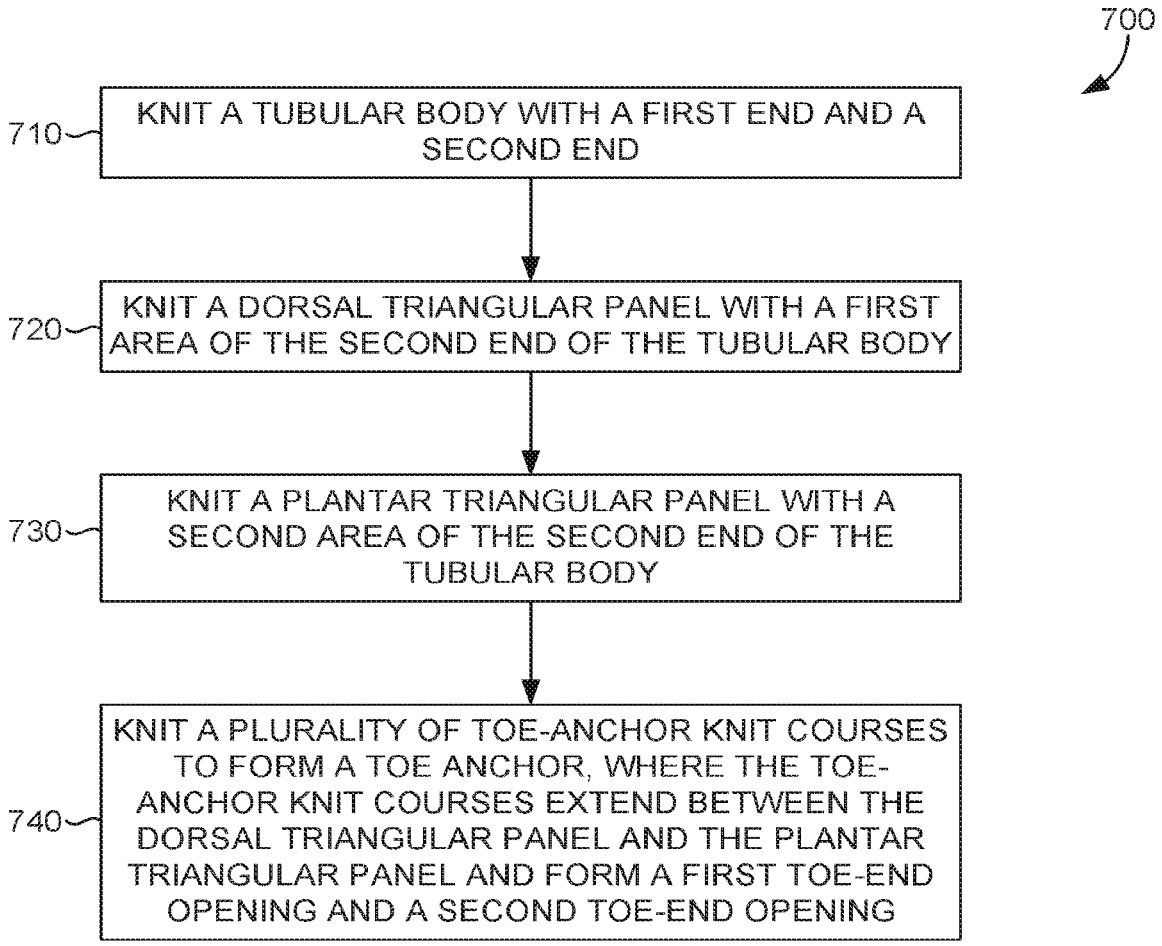
FIG. 7 illustrates a flow chart for a method of manufacturing a sock in accordance with aspects herein.

FIG. 7 is a flow diagram of an example method 700 of knitting a sock, such as the knit sock 101, in accordance with aspects herein. At step 710, a first plurality of circumferentially extending knit courses are knit on a circular knitting machine, where the circumferentially knit courses form a tubular body having a first end and a second end. At step 720, a dorsal triangular panel is knit with a first area of the second end of the tubular body. In aspects, the dorsal triangular panel comprises a dorsal base that forms a first portion of a perimeter edge of a toe-end opening of the sock. At step 730, a plantar triangular panel is knit with a second area of the second end of the tubular body where the plantar triangular panel comprises a plantar base that forms a second portion of the perimeter edge of the toe-end opening of the sock. And at step 740, a plurality of toe-anchor knit courses are knit to form a toe anchor, where the toe-anchor knit courses extend between the dorsal base and the plantar base to form a first toe-end opening and a second toe-end opening separated by the plurality of toe anchor knit courses. The order of the steps for the method 700 may be different than that described. For instance, and as described above with respect to the method 600 in FIG. 6, portions of the dorsal triangular panel and the plantar triangular panel may be knit before knitting the toe anchor, and remaining portions of the dorsal triangular panel and the plantar triangular panel may be knit after knitting the toe anchor. Any and all aspects, and any variation thereof, are contemplated as being within aspects herein.

Figure 8:
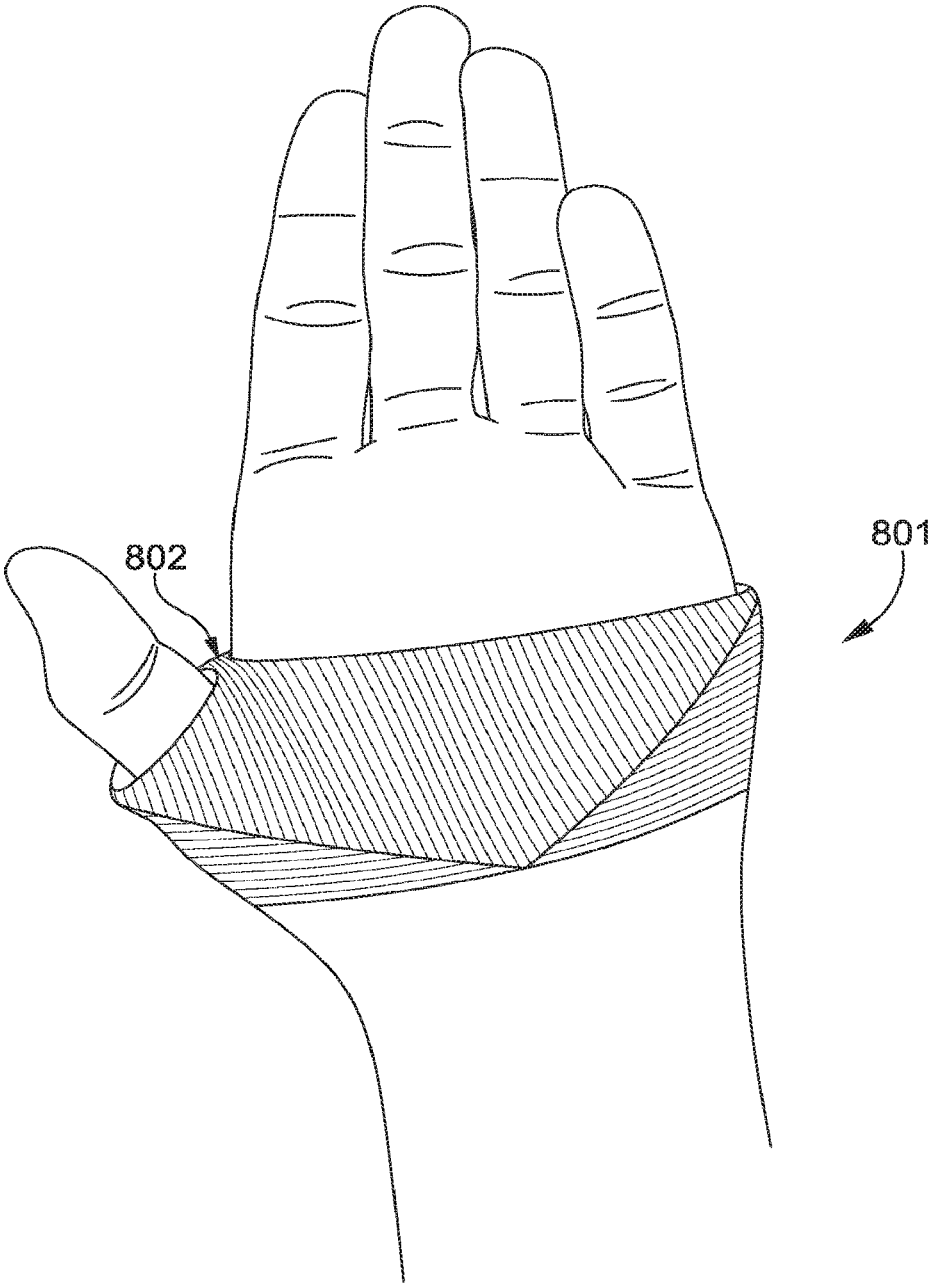
FIG. 8 illustrates an integrally knit thumb anchor in accordance with aspects herein.

It is contemplated that the present invention may be applicable to other apparel. For example, FIG. 8 displays a thumb anchor 802 that may be integrally knit into a sleeve 801 such that the thumb anchor 802 extends across a distal end of the sleeve 801 and forms a thumb aperture and an additional aperture configured to receive a wearer's remaining fingers. The thumb anchor 802 may be knit in a similar way as described in the method 600 and/or the method 700. In this example aspect, the use of integrally knit thumb-anchor knit courses, like the integrally knit toe-anchor courses, benefits the wearer by helping to secure the sleeve to an arm of the wearer. Integrally knit thumb anchors may also provide more structural stability compared to thumb anchors that are secured to the sleeve by, for example, stitching as the stitching may come undone, fray, or break causing the stitched thumb anchor to become disengaged from the sleeve. Integrally knit thumb anchors also provide a manufacturing efficiency because no additional post-knitting steps are necessary to, for instance, form the thumb anchor and affix the thumb anchor to the sleeve.

The following clauses represent example aspects of concepts contemplated herein.

Any one of the following clauses may be combined in a multiple dependent manner to depend from one or more other clauses. Further, any combination of dependent clauses (clauses that explicitly depend from a previous clause) may be combined while staying within the scope of aspects contemplated herein. The following clauses are examples and are not limiting.

Clause 1. A knit sock comprising:

a sock body comprising a tubular body forming a perimeter around a foot-receiving cavity and having a dorsal portion and a plantar portion, wherein the foot-receiving cavity comprises a toe-end opening, the tubular body comprising a plurality of circumferentially extending knit courses; and a plurality of toe-anchor knit courses integrally knit with the plurality of circumferentially extending knit courses and dividing the toe-end opening into a first toe-end opening and a second toe-end opening, wherein the plurality of toe-anchor knit courses connects the dorsal portion to the plantar portion by extending across the toe-end opening.

Clause 2. The knit sock according to clause 1, wherein the sock body further comprises a collar having a foot opening in communication with the foot-receiving cavity.

Clause 3. The knit sock according to any of clauses 1 through 2, wherein the sock body further comprises a heel opening configured to receive a heel portion of a wearer's foot when the knit sock is in an as-worn configuration.

Clause 4. The knit sock according to any of clauses 1 through 3, wherein the first toe-end opening and the second toe-end opening comprise different circumferences.

Clause 5. The knit sock according to any of clauses 1 through 4, wherein the plurality of toe-anchor knit courses comprise an elastomeric yarn.

Clause 6. The knit sock according to any of clauses 1 through 5, wherein the sock body and the plurality of toe-anchor knit courses comprise an elastomeric yarn.

Clause 7. The knit sock according to any of clauses 1 through 6, wherein the plurality of toe-anchor knit courses are oriented generally perpendicular to the plurality of circumferentially extending knit courses.

Clause 8. A knit sock comprising:

a sock body with a collar and a heel area; and a toe area integrally knit with the sock body, the toe area having a dorsal portion and a plantar portion, wherein: the dorsal portion comprises a dorsal triangular panel having a dorsal vertex that extends toward the collar and a dorsal base that forms at least a first portion of a perimeter edge of the toe area, the plantar portion comprises a plantar triangular panel having a plantar vertex that extends toward the heel area and a plantar base that forms at least a second portion of the perimeter edge of the toe area, and a plurality of toe-anchor knit courses extending between the dorsal base and the plantar base of the toe area to form a first toe-end opening and a second toe-end opening separated by the plurality of toe-anchor knit courses.

Clause 9. The knit sock according to clause 8, wherein the sock body comprises a plurality of circumferentially extending knit courses.

Clause 10. The knit sock according to any of clauses 8 through 9, wherein the dorsal portion comprises a plurality of reciprocally knit courses extending generally perpendicular to the plurality of circumferentially extending knit courses.

Clause 11. The knit sock according to any of clauses 8 through 10, wherein the plantar portion comprises a plurality of reciprocally knit courses extending generally perpendicular to the plurality of circumferentially extending knit courses.

Clause 12. The knit sock according to any of clauses 8 through 11, wherein the first toe-end opening is configured to receive a wearer's first hallux when the knit sock is in an as-worn configuration.

Clause 13. The knit sock according to any of clauses 8 through 12, wherein:

the dorsal base comprises a first dorsal base vertex and a second dorsal base vertex;

the first portion of the perimeter edge extends between the first dorsal base vertex and the second dorsal base vertex;

the plantar base comprises a first plantar base vertex and a second plantar base vertex; and the second portion of the perimeter edge extends between the first plantar base vertex and the second plantar base vertex.

Clause 14. The knit sock according to clause 13, wherein the first dorsal base vertex and the first plantar base vertex are located on a medial aspect of the toe area of the knit sock, and wherein the second dorsal base vertex and the second plantar base vertex are located on a lateral aspect of the toe area of the knit sock.

Clause 15. The knit sock according to any of clauses 8 through 14, wherein the second toe-end opening has a larger circumference than the first toe-end opening.

Clause 16. A method for knitting a sock comprising:

on a circular knitting machine, knitting a first plurality of circumferentially extending knit courses forming a tubular body with a first end and a second end;

integrally knitting a dorsal triangular panel with a first area of the second end of the tubular body, the dorsal triangular panel comprising a dorsal base that form a first portion of a perimeter edge of a toe area of the sock;

integrally knitting a plantar triangular panel with a second area of the second end of the tubular body, the plantar triangular panel comprising a plantar base that forms a second portion of the perimeter edge of the toe area of the sock; and knitting a plurality of toe-anchor knit courses extending between the dorsal base and the plantar base to form a first toe-end opening and a second toe-end opening separated by the plurality of toe-anchor knit courses.

Clause 17. The method of knitting the sock according to clause 16, wherein the dorsal triangular panel is reciprocally knit on the circular knitting machine and comprises reciprocally knit courses extending generally perpendicular to the circumferentially extending knit courses.

Clause 18. The method of knitting a sock according to any of clauses 16 through 17, wherein the plantar triangular panel is reciprocally knit on the circular knitting machine and comprises reciprocally knit courses extending generally perpendicular to the circumferentially extending knit courses.

Clause 19. The method of knitting a sock according to any of clauses 16 through 18, further comprising forming a heel opening in the tubular body, the heel opening configured to receive a heel portion of a wearer's foot when the sock is in an as-worn configuration.

Clause 20. The method of knitting a sock according to any of clauses 16 through 19, wherein the first end of the tubular body forms, at least in part, a collar of the sock.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all steps listed in the various figures need be carried out in the specific order described.

What is claimed is:

1. A method for knitting a sock comprising:

on a circular knitting machine, knitting a plurality of circumferentially extending knit courses forming a tubular body with a first end and a second end;

integrally knitting a dorsal triangular panel with the second end of the tubular body, the dorsal triangular panel comprising a dorsal base that forms a first portion of a free edge of a toe area of the sock;

integrally knitting a plantar triangular panel with the second end of the tubular body, the plantar triangular panel comprising a plantar base that forms a second portion of the free edge of the toe area of the sock;

knitting a plurality of toe-anchor knit courses extending between the dorsal base and the plantar base to form a first toe-end opening and a second toe-end opening separated by the plurality of toe-anchor knit courses; and joining the free edge of the toe area of the sock to the tubular body of the sock.

2. The method for knitting the sock of claim 1, wherein the dorsal triangular panel is reciprocally knit on the circular knitting machine and comprises reciprocally knit courses extending generally perpendicular to the plurality of circumferentially extending knit courses.

3. The method for knitting a sock of claim 1, wherein the plantar triangular panel is reciprocally knit on the circular knitting machine and comprises reciprocally knit courses extending generally perpendicular to the plurality of circumferentially extending knit courses.

4. The method for knitting a sock of claim 1, further comprising forming a heel opening in the tubular body, the heel opening configured to receive a heel portion of a wearer's foot when the sock is in an as-worn configuration.

5. The method for knitting a sock of claim 1, wherein the first end of the tubular body forms, at least in part, a collar of the sock.

6. A method for knitting a sock comprising:

on a circular knitting machine, knitting a plurality of circumferentially extending knit courses forming a tubular body with a first end and a second end;

reciprocally knitting one or more knit portions with the second end of the tubular body, the one or more knit portions defining a first toe opening and a second toe opening separated by an integrally knit toe-anchor, the one or more knit portions comprising a free edge; and seaming the free edge of the one or more knit portions to the tubular body on a lateral side of the tubular body.

7. The method of claim 6, wherein the first end of the tubular body comprises a collar having a foot opening.

8. The method of claim 6, wherein the tubular body further comprises a heel opening configured to receive a heel portion of a wearer's foot when the sock is in an as-worn configuration.

9. The method of claim 6, wherein the first toe opening and the second toe opening comprise different circumferences.

10. The method of claim 6, wherein the integrally knit toe-anchor comprises a plurality of toe-anchor knit courses knitted with an elastomeric yarn.

11. The method of claim 10, wherein the seaming of the free edge of the one or more knit portions to the tubular body orients the plurality of toe-anchor knit courses generally perpendicular to the plurality of circumferentially extending knit courses of the tubular body.

12. A method for knitting a sock comprising:

on a circular knitting machine, knitting a plurality of circumferentially extending knit courses forming a sock body with a collar and a heel area;

integrally knitting a toe area with the sock body, the toe area having a dorsal portion, a plantar portion, an integrally knit toe-anchor, a medial portion of a medial aspect, a lateral portion of a lateral aspect, and a free edge, wherein:

the dorsal portion comprises a dorsal triangular panel having a dorsal vertex that extends toward the collar and a dorsal base that forms at least a first portion of a perimeter edge of the toe area, the plantar portion comprises a plantar triangular panel having a plantar vertex that extends toward the heel area and a plantar base that forms at least a second portion of the perimeter edge of the toe area, and the lateral portion comprises a lateral base forming the free edge, the integrally knit toe-anchor comprises a plurality of toe-anchor knit courses extending between the dorsal base and the plantar base of the toe area to form a first toe-end opening and a second toe-end opening separated by the plurality of toe-anchor knit courses; and joining the free edge of the toe area to the sock body.

13. The method of claim 12, wherein the integrally knit toe-anchor comprises the plurality of toe-anchor knit courses knitted with an elastomeric yarn.

14. The method of claim 12, wherein the dorsal portion comprises a plurality of reciprocally knit courses extending generally perpendicular to the plurality of circumferentially extending knit courses of the sock body when the free edge of the toe area is joined to the sock body.

15. The method of claim 14, wherein the plantar portion comprises the plurality of reciprocally knit courses extending generally perpendicular to the plurality of circumferentially extending knit courses when the free edge of the toe area is joined to the sock body.

16. The method of claim 12, wherein the first toe-end opening is configured to receive a wearer's first hallux when the sock is in an as-worn configuration.

17. The method of claim 12, wherein:

the dorsal base comprises a first dorsal base vertex and a second dorsal base vertex;

the first portion of the perimeter edge extends between the first dorsal base vertex and the second dorsal base vertex;

the plantar base comprises a first plantar base vertex and a second plantar base vertex; and the second portion of the perimeter edge extends between the first plantar base vertex and the second plantar base vertex.

18. The method of claim 17, wherein the first dorsal base vertex and the first plantar base vertex are located on the medial aspect of the toe area of the sock, and wherein the second dorsal base vertex and the second plantar base vertex are located on a lateral aspect of the toe area of the sock.

19. The method of claim 12, wherein the second toe-end opening has a larger circumference than the first toe-end opening.

20. The method of claim 12, wherein the integrally knit toe-anchor comprises a plurality of reciprocally knit courses extending generally perpendicular to the plurality of circumferentially extending knit courses when the free edge of the toe area is joined to the sock body.

* * * * *